US009500357B2

(12) United States Patent
Stolte et al.

(10) Patent No.: US 9,500,357 B2
(45) Date of Patent: Nov. 22, 2016

(54) LED LIGHT FIXTURE HAVING CIRCUMFERENTIALLY MOUNTED DRIVERS ADJACENT EXTERNAL HEAT SINKS

(71) Applicant: KENALL MANUFACTURING COMPANY, Kenosha, WI (US)

(72) Inventors: Brandon Stolte, Lindenhurst, IL (US); Kevin Dahlen, Lindenhurst, IL (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 0 days.

(21) Appl. No.: 14/954,405

(22) Filed: Nov. 30, 2015

(65) Prior Publication Data

US 2016/0076756 A1 Mar. 17, 2016

Related U.S. Application Data

(63) Continuation of application No. 13/840,992, filed on Mar. 15, 2013, now Pat. No. 9,228,733.

(51) Int. Cl.

| | |
|---|---|
| ***F21V 15/01*** | (2006.01) |
| ***F21V 29/83*** | (2015.01) |
| ***F21V 23/00*** | (2015.01) |
| ***F21V 29/507*** | (2015.01) |
| ***F21V 29/77*** | (2015.01) |
| ***F21V 3/00*** | (2015.01) |
| *F21Y 101/00* | (2016.01) |

(52) U.S. Cl.

CPC ..... *F21V 29/83* (2015.01); *F21V 3/00* (2013.01); *F21V 15/01* (2013.01); *F21V 23/008* (2013.01); *F21V 23/009* (2013.01); *F21V 29/507* (2015.01); *F21V 29/77* (2015.01); *F21V 29/777* (2015.01); *F21Y 2101/00* (2013.01)

(58) Field of Classification Search

None

See application file for complete search history.

(56) References Cited

U.S. PATENT DOCUMENTS

| | | | | |
|---|---|---|---|---|
| 7,144,135 | B2 | 12/2006 | Martin et al. | |
| 7,914,182 | B2 | 3/2011 | Mrakovich et al. | |
| 8,240,885 | B2 | 8/2012 | Miller | |
| 8,272,765 | B2 | 9/2012 | Ter-Hovhannisyan | |
| 9,228,733 | B2 * | 1/2016 | Stolte | F21V 23/008 |
| 2012/0176792 | A1 | 7/2012 | Stolte et al. | |
| 2012/0176797 | A1 | 7/2012 | Stolte et al. | |
| 2013/0301259 | A1 | 11/2013 | Ahn | |

* cited by examiner

*Primary Examiner* — Stephen F Husar

(74) *Attorney, Agent, or Firm* — Marshall, Gerstein & Borun LLP; Randall G. Rueth

(57) ABSTRACT

A light fixture and a housing thereof for managing thermal energy includes multiple cavities separated by a partition wall and each configured to house components of the light fixture, in particular an LED array and LED drivers to power the LED array. The housing further includes a heat transfer flow path radially defined between the first cavity and the partition wall, and a fin in fluid communication with the cavity housing the LED drivers. The heat transfer flow path is positioned for dissipation of heat from the LED array and the fin is positioned for dissipation of heat from the LED drivers.

20 Claims, 4 Drawing Sheets

LED LIGHT FIXTURE HAVING CIRCUMFERENTIALLY MOUNTED DRIVERS ADJACENT EXTERNAL HEAT SINKS

CROSS-REFERENCE TO RELATED APPLICATIONS

This application is a continuation of and claims priority to U.S. patent application Ser. No. 13/840,992, filed Mar. 15, 2013, now U.S. Pat. No. 9,228,733, the disclosure of which is fully incorporated by reference in its entirety.

TECHNICAL FIELD

The present disclosure generally relates to a system and method for an LED light fixture configured to manage thermal energy. In particular, the present disclosure relates to platforms and techniques for an LED light fixture having circumferentially mounted drivers with corresponding external heat sinks.

BACKGROUND

A light emitting diode (LED) is a semiconductor light source used in light fixtures or luminaires. LEDs are available across the visible, ultraviolet, and infrared spectrums and offer energy savings over conventional incandescent light bulbs. LED drivers are electrical components that deliver current to the LEDs to correspondingly illuminate the LEDs. However, an LED can generate an abundance of heat with its diode semiconductor structure. Additionally, LEDs and their drivers can be more sensitive to higher temperatures than can incandescent light bulbs. Accordingly, LEDs and their drivers require precise and effective heat management to ensure proper operation.

Various existing LED fixtures have heat management systems that include heat sinks with dedicated vents or openings that dissipate heat from the LEDs and the LED drivers. In some cases, the fixtures include a curved lens that acts in combination with the heat sinks to cool the fixture by accounting for thermal updrafts caused by free convection of waste heat. However, the existing heat management systems can limit the size of the LED fixtures and the resulting lumen output thereof. Accordingly, there is an opportunity to provide LED fixtures with heat management systems that more effectively and efficiently manage the heat generated by the fixtures and that allow for larger and more powerful LED fixtures.

GENERAL DESCRIPTION

One aspect of the present disclosure includes a light fixture having a housing with a first cavity and a second cavity separated by a partition wall, where the second cavity is disposed radially outward from the first cavity. The light fixture further comprises a light emitting diode (LED) array in the first cavity, the LED array for generating light; and at least one heat transfer flow path radially defined adjacent the partition wall and outside of the second cavity. Further, the light fixture comprises at least one driver configured to illuminate the LED array, and disposed in the second cavity and outside of the at least one heat transfer flow path.

Another aspect of the present disclosure includes a housing for a light fixture having a first cavity adapted to house a light emitting diode (LED) array. The housing further comprises a second cavity disposed radially outward from the first cavity, the second cavity 1) adapted to house at least one driver for illuminating the LED array and 2) separated from the first cavity by a partition wall. Further, the housing comprises at least one heat transfer flow path defined at least partially by the first cavity and separated from the second cavity by the partition wall, and at least one fin in fluid communication with the second cavity.

Yet another aspect of the present disclosure includes a light fixture having a housing having a first cavity enclosing a light emitting diode (LED) array, a heat transfer flow path defined at least partially by the first cavity and for dissipating heat generated by the LED array, and a second cavity disposed radially outward from the first cavity and separated from the first cavity by a partition wall. The light fixture further comprises at least one driver configured to illuminate the LED array and disposed within the second cavity, and at least one fin in fluid communication with the second cavity.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
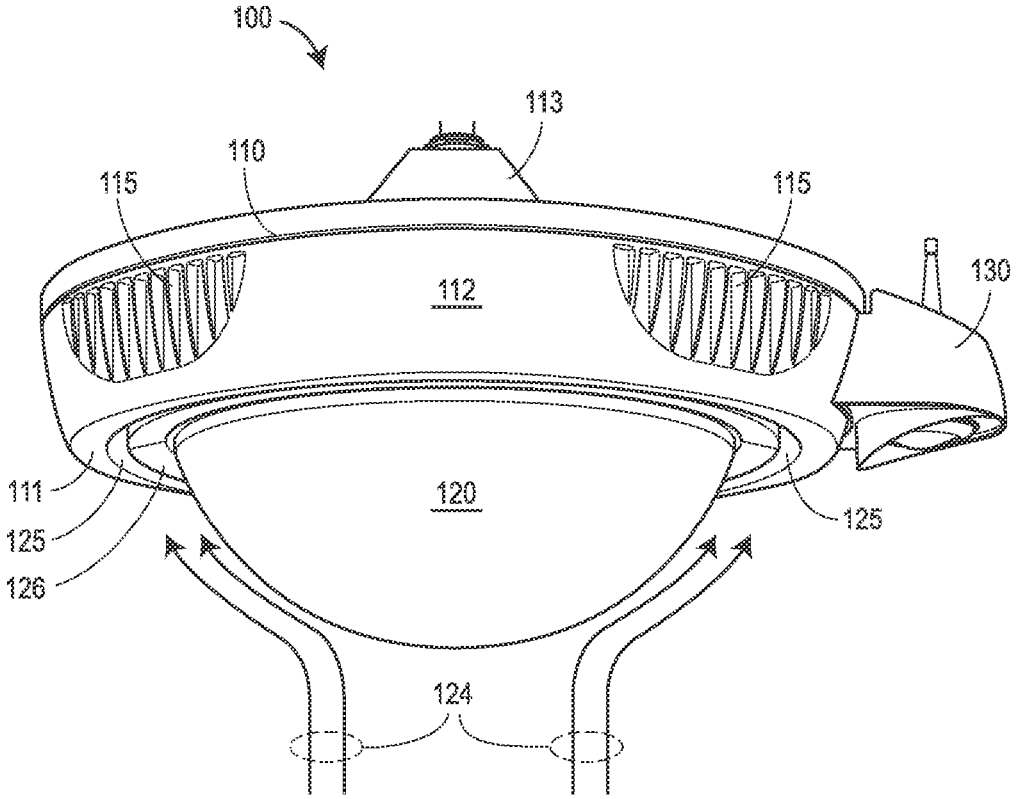
FIG. 1 is a perspective view of a light fixture in accordance with some embodiments of the present disclosure.

Referring to FIG. 1, depicted is a perspective view of a light fixture 100 in accordance with some embodiments of the present disclosure. The light fixture 100 includes a housing 110 that can be in a shape of a disc or other shape.

It should be appreciated that the housing 110 can be composed of a singular or multiple part(s), section(s), piece(s), and/or the like. As shown in FIG. 1, the housing 110 of the light fixture 100 has a circular or oval shape, and includes a bottom surface 111 and an outside wall 112. Although not depicted in FIG. 1, it should be appreciated that other shapes and configurations for the light fixture 100 and the housing 110 are envisioned.

The bottom surface 111 can have a domed lens 120 attached thereto. In some embodiments, the shape of the domed lens 120 where it secures to the bottom surface 111 approximates the shape of the perimeter or circumference of the housing 110. The domed lens 120 can be configured to filter and/or disperse light generated by a light source such as an array of LEDs (not shown in FIG. 1) within the housing 110. It should be appreciated that other shapes for the domed lens 120 are envisioned, such as flat, square, rectangular, or the like. Further, it should be appreciated that that the housing 110 can be equipped with other optional light sources as well as with an appropriate mounting structure, power source interface, and control electronics to generate and control light from the light fixture 100. As shown in FIG. 1, the light fixture 100 can be equipped with an optional wireless control 130 configured to control various functions and controls of the light fixture 100. For example, the wireless control 130 can sense movement and, responsive to the sensing, can turn on the light source, e.g., LED array, within the housing 110.

As shown in FIG. 1, the bottom surface 111 of the housing 110 can have an opening or vent 125 incorporated therein and positioned as an inlet to a heat transfer flow path, which is described below, within the housing 110. The vent 125 can be annular in shape and can be radially located on the bottom surface 111 of the housing 110 (and specifically around where the domed lens 120 secures to the bottom surface 111). As shown in FIG. 1, there can be a rib 126 between the vent 125 and where the domed lens 120 secures to the bottom surface 111. According to some embodiments, the vent 125 is configured to facilitate the transfer and dissipation of heat associated with the light fixture 100. In particular, the LED array and other components of the light fixture 100 such as a cover 113 generate heat that causes an updrift of air, indicated by arrows 124 in FIG. 1, from below which is directed toward the bottom surface 111. The domed lens 120 is positioned to channel the updrift of air 124 into the vent 125. It is generally understood that the air 124 can comprise a laminar flow diverging or deflecting from the center or sides of the domed lens 120 and concentrating near the corresponding intake section of the vent 125. Although not shown in FIG. 1, the dimensions of the interior of the vent 125 and the parts thereof can cause the channeled air to experience a "Venturi effect" which lowers pressure and increases airflow through the vent 125, as generally understood in the art. In some embodiments, the housing 110 can have a grate (not shown in FIG. 1) secured thereto and positioned to cover the vent 125 such to partition the vent 125 into distinct air intake channels.

According to embodiments, the outside wall 112 can be flat or curved and can extend upwardly from the bottom surface 111. The outside wall 112 can also have one or more fins 115 located thereon. In some embodiments, multiple fins 115 can be circumferentially spaced throughout the outside wall 112. The fins 115 can be configured to dissipate heat generated by LED drivers (not shown in FIG. 1) within the housing 110 that illuminate the LED array, effectively acting as heat sinks for the LED drivers. It should be appreciated that other shapes and types of fins are contemplated other than those depicted in FIG. 1. Further, the fins 115 can be conventional heat sink fins which are not associated with openings through the housing 110 into the second cavity 152, or in other versions, the fins 115 could be fins associated with openings in the housing 110 that communicate with the second cavity 152. For example, the fins 115 can be unidirectional whereby the fins 115 enable air to dissipate from the housing 110 but do not enable exterior air to enter the housing 110. The locations of the fins 115 can correspond to the locations of the associated LED drivers. For example, if there are four (4) sets of LED drivers that power the LED array, the outside wall 112 can include four (4) sets of fins 115 positioned based on the locations of the sets of LED drivers to dissipate heat from the sets of LED drivers. According to some embodiments, the fins 115 can be spaced equidistant apart or spaced according to other distances.

Figure 2:
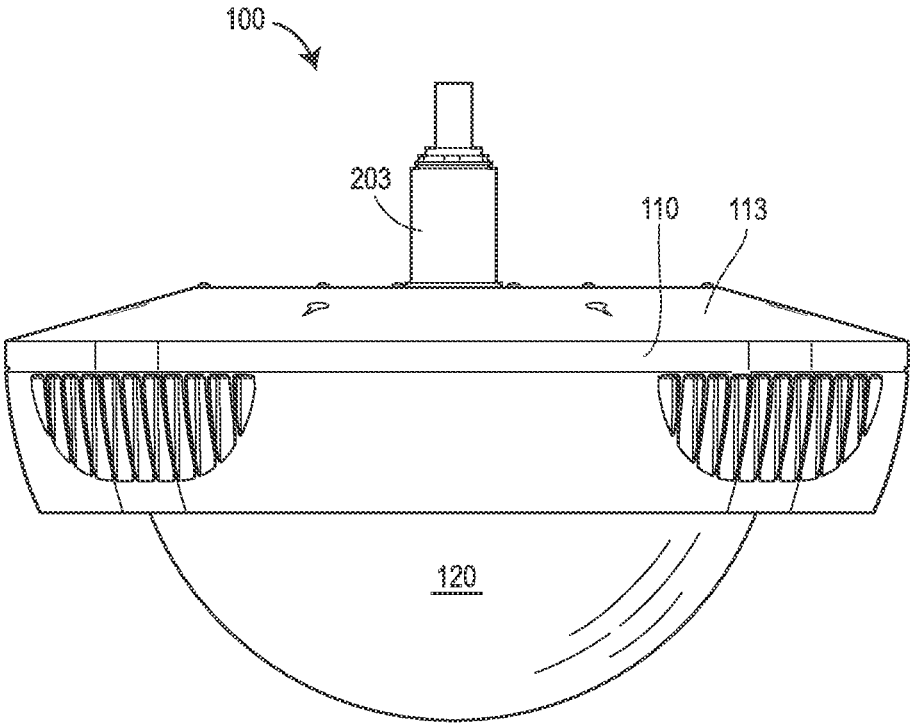
FIG. 2 is an additional perspective view of a light fixture in accordance with some embodiments of the present disclosure.
Figure 3:
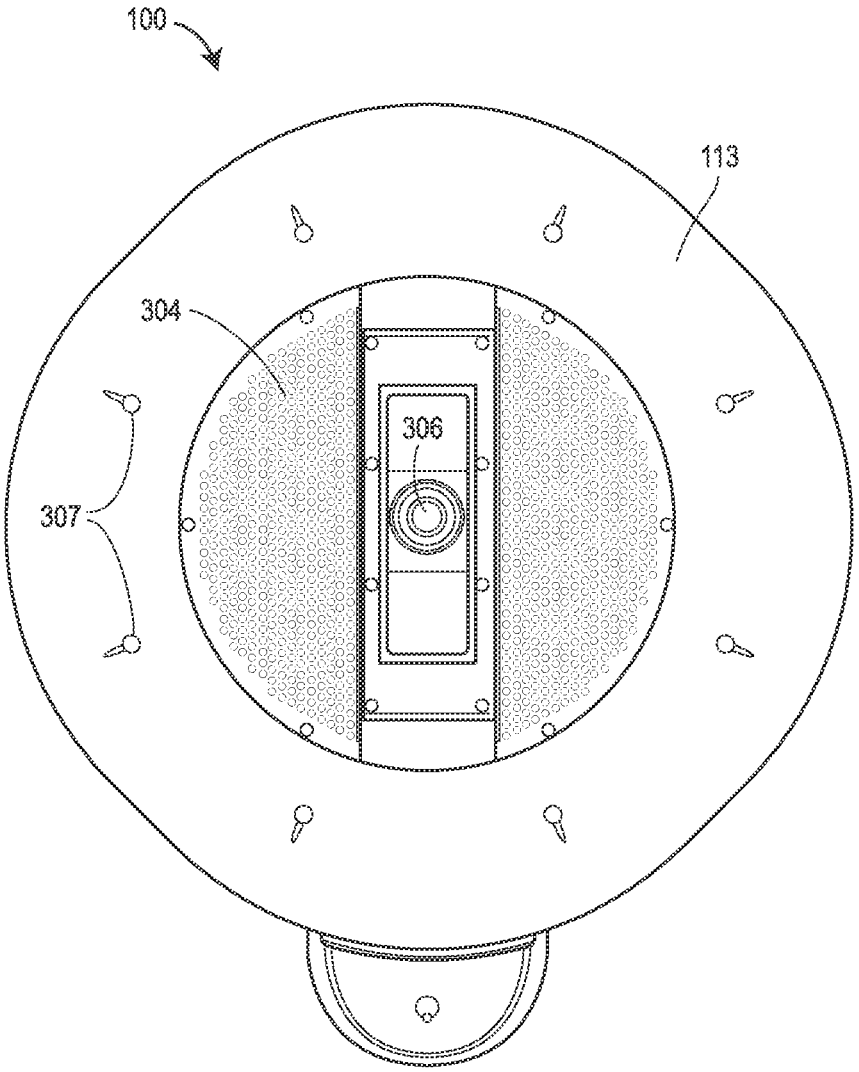
FIG. 3 is a top view of a light fixture in accordance with some embodiments of the present disclosure.

Referring to FIG. 2, depicted is another perspective view of the light fixture 100. In addition to the housing 110 and the domed lens 120, the light fixture 100 includes the cover 113 that can be secured to a mounting member 203. The mounting member 203 can conduct power to the light fixture 100 to enable operation of the light fixture 100. The cover 113 can be removably secured to the mounting member 203 and the housing 110 can be removably secured to the cover 113, as generally understood in the art. Referring to FIG. 3, a top view of the light fixture 100 is depicted. As shown in FIG. 3, the cover 113 has a series of screws 307 or similar attaching components configured to secure the cover 113 to the housing 110. Further, the cover 113 can have a grill 304 defining a plurality of exhaust openings secured thereto as well as a socket 306 for securing the light fixture 100 to the mounting member 203 of FIG. 2. According to embodiments, the grill 304 can be in fluid communication with a heat transfer flow path (not shown in FIG. 3) for exhausting heat from the light fixture 100. It should be appreciated that the configurations as depicted in FIGS. 2 and 3 are merely an example and that other configurations and components thereof are envisioned.

Figure 4:
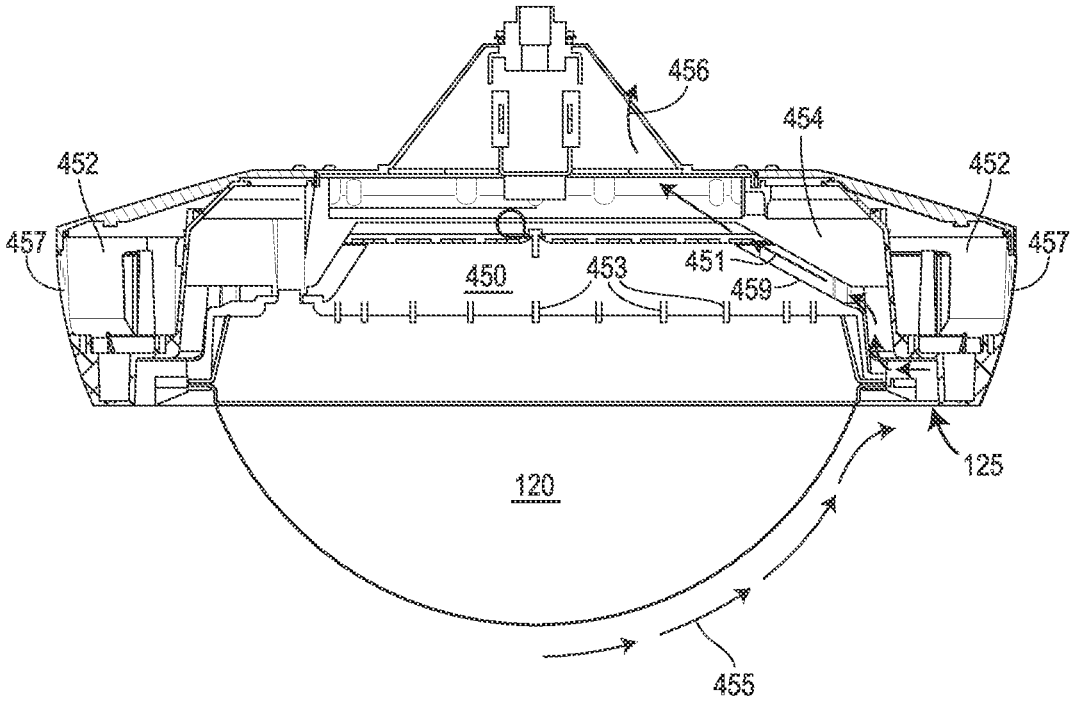
FIG. 4 is a cross-sectional view of a light fixture in accordance with some embodiments of the present disclosure.

FIG. 4 depicts a cross-sectional view of the light fixture 100 in accordance with some embodiments. As shown, the cross-sectional view is from a plane approximately aligned with the center of the light fixture 100. The light fixture 100 as shown in FIG. 4 includes the housing 110 having a first cavity 450 and a second cavity 452. According to some embodiments, the second cavity 452 is disposed radially outward from the first cavity 450 and throughout the housing 110. Moreover, the first and second cavities of the disclosed version of the housing 110 are not in fluid communication with each other. Said another way, the first and second cavities 450, 452 are fluidly isolated from each other. However, it should be appreciated that in some other versions, it is possible to provide some level of fluid communication between the first and second cavities 450, 452, if desired, in a manner that does not detract from the intended objectives of the disclosure. Accordingly, FIG. 4 depicts two instances of the second cavity 452, one of the left and one on the right, even though the second cavity 452 depicted on the right side of FIG. 4 may be connected to the second cavity 452 depicted on the left side of FIG. 4. It should be appreciated that the second cavity 452 can be a single continuous cavity or can be segmented into multiple discrete sections. In versions where the second cavity 452 includes a single cavity extending around the first cavity 450, it can be said that the second cavity 452 includes an annular cavity, for example, at least partially encircling and/or surrounding the first cavity 450.

The first cavity 450 is adapted to house an LED array 453 including a plurality of individual LEDs. As described herein, the LED array 453 generates light and directs the light outwardly from the light fixture 100 and through the domed lens 120 and optionally through one or more additional lenses (not shown in FIG. 4). The second cavity 452 is adapted to house at least one driver configured to illuminate the LED array 453. The at least one driver can couple to the LED array 453 via conventional techniques and/or components, such as a wiring configuration within the housing 110.

As shown in FIG. 4, the housing 110 can include at least one fin 457 that fluidly connects the exterior of the housing 110 with the second cavity 452 and the LED driver(s) thereof. The at least one fin 457 in FIG. 4 can resemble exactly the fins 115 described above in reference to FIG. 1, for example. As such, there can be multiple fins 457 circumferentially spaced throughout the outside wall 112 of the housing 110. Further, each of the multiple fins 457 can correspond with at least one LED driver or set of LED drivers housed within the second cavity 452. For example, if there are four (4) sets of LED drivers equally spaced throughout the second cavity 452, then there can be four (4) sets of fins 457 correspondingly and radially spaced throughout the outside wall of the housing 110. For further example, in cases in which the second cavity 452 is segmented into multiple sections, there can be an amount of fins 457 corresponding to the amount of sections of the second cavity 452.

In operation, heat generated by the LED array 453 warms air surrounding the LED array 453 (such as the air in 450 or 451) and causes the surrounding air to rise. This is generally referred to as convection whereby a passive transfer of heat into a fluid (e.g., the air) causes differences in density of the air that thereby causes the flow of air in a general upward direction or draft. Cooler air from below the light fixture 100 rises due to the pressure differential and, as referenced by 455 in FIG. 4, the air is channeled into a heat transfer flow path 451 via the vent 125 (as discussed with respect to FIG. 1). As shown, the flow path 451 can be defined in the first cavity 450 of the housing 110. The air within the heat transfer flow path 451 acts to transfer or dissipate the heat within the first cavity 450 generated by the LED array 453, wherein the air exits (456) the heat transfer flow path 451 through the top of the housing 110, as indicated by reference number 456 (such as through the grill 304 as depicted in FIG. 3). The heat transfer flow path 451 can be circumferentially or radially disposed within the housing 110 such that the domed lens 120 can direct the air to enter the heat transfer flow path 451 via the vent 125 at any circumferential location. In some embodiments, the heat transfer flow path 451 can be segmented into multiple paths radially spaced on the bottom surface of the housing 110.

The LED drivers within the second cavity 452 generate heat when providing power to the LED array 453. Further, the fin(s) 457 dissipate the generated heat within the second cavity 452 to the exterior of the housing 110, effectively acting as a heat sink for the LED drivers. As shown in FIG. 4, a partition wall 454 separates the first cavity 450 (and the heat transfer flow path 451) from the second cavity 452 such that the first and second cavities 450, 452 are not in fluid communication with each other. That is, the first and second cavities 450, 452 are isolated from each other. Moreover, the partition wall 454 isolates the heat transfer flow path 451 from the second cavity 452. It should be appreciated that the partition wall 454 can be various thicknesses and composed of various elements or materials. Moreover, the wall 454 can have various shapes and configurations. In the depicted form, the partition wall 454 is shaped and configured in a stepped fashion that also converges from the vent 125 to the grill 304. As such, the heat transfer flow path 451 also has a converged or angled flow path. This convergence can, in some instances, create a nozzle type effect that assists in moving air flow through the flow path 451 to remove heat from the first cavity 450. In other versions, the partition wall 454 need not be convergent.

According to some embodiments, the flow of air through the heat transfer flow path 451 is separated (e.g., isolated), via the partition wall 454, from the heat dissipated from the second cavity 452 through the fin(s) 457. Accordingly, because the fin(s) 457 in combination with the heat transfer flow path 451 effectively dissipates a sufficient amount of heat respectively generated by the LED array 435 and the LED drivers to enable the light fixture 100 to operate effectively, the light fixture 100 itself can be larger, be more powerful, and have a greater lumen output than conventional light fixtures.

In embodiments, the first cavity 450 can at least partially define the shape or configuration of the heat transfer flow path 451. In some cases, the heat transfer flow path 451 can fluidly communicate with the first cavity 450 via an opening or channel (not shown in FIG. 4). In further cases, an optional partition 459 can be disposed between at least a portion of the heat transfer flow path 451 and the first cavity 450 such that the air flow through the heat transfer flow path 451 is partially or wholly separated from the first cavity 450 but still enables the heat transfer flow path 451 to dissipate heat generated by the LED array 453 within the first cavity 450. In still further cases, the heat transfer flow path 451 can be a part of the first cavity 450, such as if there is no partition between the heat transfer flow path 451 and the first cavity 450, such that the airflow that enters the heat transfer flow path 451 via the vent 125 can intermix with the environment of the first cavity 450.

This detailed description is to be construed as exemplary only and does not describe every possible embodiment, as describing every possible embodiment would be impractical, if not impossible. One could implement numerous alternate embodiments, using either current technology or technology developed after the filing date of this application.

What is claimed:

1. A light fixture comprising:

a housing defining a first cavity and a second cavity, the second cavity disposed radially outward from the first cavity;

a partition wall at least partially disposed radially between the first cavity and the second cavity, and at least partially separating the first cavity and the second cavity;

a light source enclosed within the first cavity and configured to generate light;

at least one heat transfer flow path disposed in fluid communication with the first cavity of the housing and opposite the partition wall from the second cavity; and at least one driver configured to illuminate the light source, the at least one driver disposed in the second cavity such that it is outside of the at least one heat transfer flow path.

2. The light fixture of claim 1, further comprising at least one opening in the housing, the at least one opening in fluid communication with the at least one driver and not in fluid communication with the first cavity.

3. The light fixture of claim 1, wherein the at least one heat transfer flow path is in fluid communication with the first cavity and not in fluid communication with the second cavity.

4. The light fixture of claim 1, wherein the second cavity has multiple cavities each containing a driver of the at least one driver.

5. The light fixture of claim 1, wherein the housing is divided into at least two parts.

6. The light fixture of claim 1, further comprising one or more exhaust openings in a top of the housing, the one or more exhaust openings in fluid communication with the at least one heat transfer flow path for exhausting heat from the first cavity of the housing.

7. The light fixture of claim 1, further comprising a lens secured to the housing and through which the light generated by the light source is directed.

8. The light fixture of claim 1, wherein the heat transfer flow path is part of the first cavity.

9. A housing for a light fixture, comprising:

an outside wall;

a first cavity defined inside of the outside wall and adapted to contain a light source;

a second cavity defined inside of the outside wall and disposed radially outward of the first cavity, the second cavity adapted to house at least one component for illuminating the light source;

a partition wall disposed radially between the first cavity and the second cavity to at least partially isolate the first cavity from the second cavity;

at least one heat transfer flow path defined at least partially by the first cavity and at least partially separated from the second cavity by the partition wall; and at least one opening in the outside wall in fluid communication with the second cavity.

10. The housing of claim 9, wherein the second cavity has multiple cavities each corresponding to one openings of the at least one opening.

11. The housing of claim 9, further comprising at least one exhaust opening in fluid communication with the at least one heat transfer flow path for exhausting heat from the at least one heat transfer flow path.

12. The housing of claim 9, wherein the at least one heat transfer flow path is in fluid communication with the first cavity and not in fluid communication with the second cavity.

13. The housing of claim 9, wherein the at least one heat transfer flow path is part of the first cavity.

14. The housing of claim 9, wherein the at least one heat transfer flow path and the partition wall are radially disposed between the first cavity and the second cavity.

15. A light fixture comprising:

a housing comprising:

an outside wall, a first cavity disposed inside of the outside wall and enclosing a light source, a heat transfer flow path defined at least partially by the first cavity for dissipating heat generated by the light source, and a second cavity disposed inside of the outside wall and radially outward of the first cavity and at least partially separated from the first cavity by a partition wall;

at least one driver configured to illuminate the light source and disposed within the second cavity; and at least one opening in the outside wall and in fluid communication with the second cavity.

16. The light fixture of claim 15, wherein the heat transfer flow path is at least partially defined by the first cavity adjacent to the partition wall.

17. The light fixture of claim 15, wherein the heat transfer flow path is in fluid communication with the first cavity.

18. The light fixture of claim 15, wherein the at least one heat transfer flow path and the partition wall are disposed radially between the first cavity and the second cavity.

19. The light fixture of claim 15, wherein the heat transfer flow path is part of the first cavity.

20. The light fixture of claim 15, wherein the housing is divided into at least two parts connected together.

* * * * *